US012188737B1

(12) United States Patent
Shen

(10) Patent No.: US 12,188,737 B1
(45) Date of Patent: Jan. 7, 2025

(54) MODULAR ADAPTER FOR FIREARM RECEIVER

(71) Applicant: Trarms, Inc., Pomona, CA (US)

(72) Inventor: Feng Shen, Diamond Bar, CA (US)

(73) Assignee: TRARMS, INC., Pomona, CA (US)

( * ) Notice: Subject to any disclaimer, the term of this patent is extended or adjusted under 35 U.S.C. 154(b) by 0 days.

(21) Appl. No.: 18/385,489

(22) Filed: Oct. 31, 2023

(51) Int. Cl.
*F41A 3/66* (2006.01)
*F41C 23/20* (2006.01)
*F41G 11/00* (2006.01)

(52) U.S. Cl.
CPC ..... *F41A 3/66* (2013.01); *F41C 23/20* (2013.01); *F41G 11/003* (2013.01)

(58) Field of Classification Search
CPC ..... F41A 3/66; F41A 11/02; F41C 23/20
See application file for complete search history.

(56) References Cited

U.S. PATENT DOCUMENTS

D636,044 S * 4/2011 Larson ..... D22/108
8,240,075 B1 * 8/2012 Mullin ..... F41G 11/003 42/122
8,720,099 B1 * 5/2014 Sisk ..... F41C 23/14 42/73
D831,149 S * 10/2018 Barfoot ..... D22/108
10,598,450 B1 * 3/2020 Welch ..... F41A 11/02
10,690,441 B2 * 6/2020 Washburn, III ..... F41G 11/003
11,231,242 B1 * 1/2022 Davis ..... F41A 11/02
11,346,622 B2 * 5/2022 Heuss ..... F41A 3/66
D1,004,038 S * 11/2023 Yudys ..... D22/108
2005/0215092 A1 * 9/2005 Schoppman ..... F41C 23/04 439/101
2010/0307042 A1 * 12/2010 Jarboe ..... F41A 3/18 42/2
2011/0271827 A1 * 11/2011 Larson ..... F41A 21/34 89/193
2017/0122698 A1 * 5/2017 Chu ..... F41B 11/70

OTHER PUBLICATIONS

U.S. Appl. No. 12/085,358, filed Sep. 10, 2024, Sisk; Charles.*

* cited by examiner

*Primary Examiner* — Joshua E Freeman
(74) *Attorney, Agent, or Firm* — Pujie Zheng

(57) ABSTRACT

A modular adapter for a firearm receiver that has a threaded socket, such as an AR-platform rifle, has a receiver surface with a threaded plug that is rotatable and configured to engage the threaded socket of the firearm receiver, a distal surface that provides a means to attach an accessory, e.g., a portion of MIL-STD 1913 accessory mounting rail, or function as an end cap, and a knob-driven mechanism, i.e., a mechanism that a hand could operate to cause the threaded plug to rotate and thereby engage the receiver, positioned between the receiver surface and the distal surface, and connected to and able to rotate the threaded plug.

11 Claims, 7 Drawing Sheets

MODULAR ADAPTER FOR FIREARM RECEIVER

FIELD OF THE INVENTION

The present invention relates to an adapter between an accessory, such as a stock, and a firearm receiver. It could also be used as an end cap.

BACKGROUND OF THE INVENTION

AR-15 is one of the most popular platforms, produced by numerous manufacturers and adopted by many nations in producing their own variations, including many modern sporting rifles.

Some manufacturers have made full upper receivers of AR-15-platform, including bufferless bolt carrier systems, where the buffer system is wholly contained in the upper receiver, and thus does not use the buffer tube, thereby allowing the operation of the rifle without a stock.

With that development, various accessories may be installed onto the receivers. Various inventions in this field, such as U.S. Pat. Nos. 10,598,450 and 10,690,441, provide modular ways for that purpose. Those inventions require tools to install and uninstall the adapter to the rifle receivers.

SUMMARY OF THE INVENTION

As one of the advantages, the present invention provides an adapter that allows the user to install and uninstall the adapter to the rifle receiver toollessly, by using a knob-driven mechanism, i.e., a mechanism that could be operated by hand to rotate the threaded plug, between a receiver surface and a distal surface of the adapter.

Various adaptive mechanisms could be manufactured on the distal surface to allow the attachment of various accessories. In one of the embodiments, the adaptive mechanism is a portion of MIL-STD 1913 accessory mounting rail, used to attach an accessory that is also equipped with the said rail. The adapter could also be used as an end cap.

Figure 1:
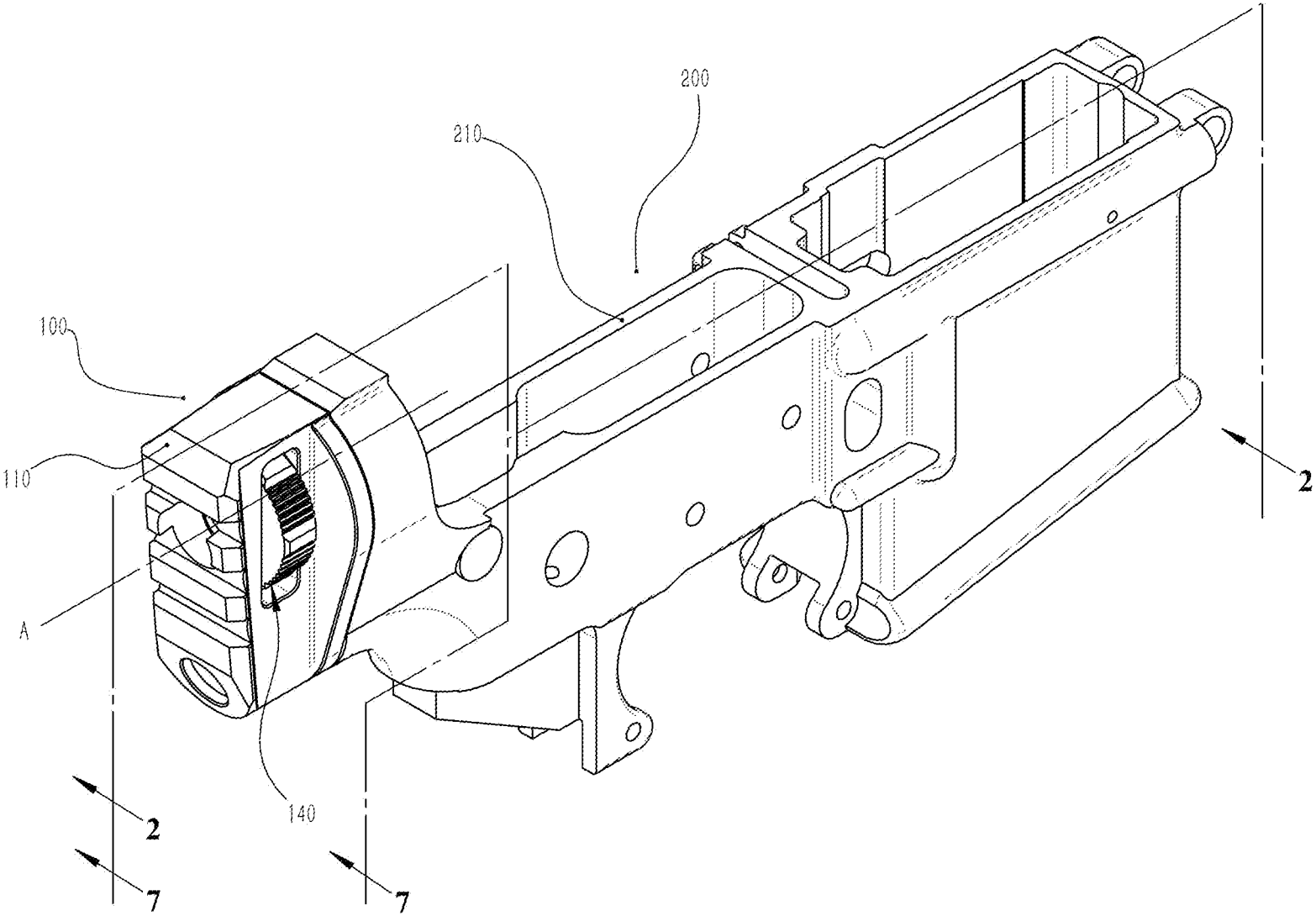
FIG. 1 is a perspective view of an embodiment of the present invention assembled to an AR-pattern lower receiver.

The figure is not necessarily in scale as some components may be shown to be out of proportion than the size in actual implementation to clearly illustrate the concept of the present invention.

DETAILED DESCRIPTION

Detailed embodiments and implementations of the claimed subject matters are disclosed herein. However, it shall be understood that the disclosed embodiments and implementations are merely illustrative of the claimed subject matters which may be embodied in various forms. The present disclosure may, however, be embodied in many different forms and should not be construed as limited to the exemplary embodiments and implementations set forth herein. Rather, these exemplary embodiments and implementations are provided so that description of the present disclosure is thorough and complete and will fully convey the scope of the present disclosure to those skilled in the art. In the description below, details of well-known features and techniques may be omitted to avoid unnecessarily obscuring the presented embodiments and implementations.

The position terms used in the present disclosure, such as "front," "forward," "rear," or the like assume a firearm in the normal firing position, with the firearm being in a position in which the longitudinal axis of the barrel of the firearm runs generally horizontally and the direction of firing points "forward" away from the user of the firearm. The same convention applies for the direction statements used herein.

As used herein, the terms "distal" and "distally" may denote "rearward" and "rearwardly" with respect to the firearm. As used herein, the verb "to comprise" in this description, claims, and other conjugations are used in its non-limiting sense to mean those items following the word are included, but items not specifically mentioned are not excluded. Reference to an element by the indefinite article "a" or "an" does not exclude the possibility that more than one of the elements are present, unless the context clearly requires that there is one and only one of the elements. The indefinite article "a" or "an" thus usually means "at least one." Additionally, the words "a" and "an" when used in the present document in concert with the words "comprising" or "containing" denote "one or more."

All numeric values are herein assumed to be modified by the term "about," whether or not explicitly indicated. The term "about" generally refers to a range of numbers that one of skill in the art would consider equivalent to the recited value (i.e., having the same function or result). In many instances, the terms "about" may include numbers that are rounded to the nearest significant figure. The recitation of numerical ranges by endpoints includes all numbers within that range (e.g., 1 to 5 includes 1, 1.5, 2, 2.75, 3, 3.80, 4, and 5). All dimensions given herein are by way of examples to better illustrate the present disclosure embodiments and shall not be construed to limit the dimensions of the present disclosure embodiments to the given numeric values.

A MIL-STD-1913 rail, which may also be known, and herein referred to, as a 1913 rail, Picatinny rail, Picatinny rail system, Picatinny interface, or STANAG 2324 rail, is an American-designed rail integration system that provides a mounting platform for firearm accessories. It was originally used for mounting scopes atop the receivers of larger caliber rifles. Currently, firearm manufacturers have adopted the Picatinny interface for the attachment of a variety of accessories.

Each of FIGS. 1-7 illustrates a perspective view and/or a cross-sectional portion and/or an exploded view of an adapter 100 in accordance with an implementation of the present disclosure. The adapter 100 may be implemented on (e.g., attached to, installed on, or mounted on) a firearm 200 such as a rifle, carbine, or pistol. The firearm 200 may include, among other components (such as a barrel, an upper receiver and a pistol grip), a lower receiver 210, e.g., a firearm based on the AR platform, whereon the adapter 100 may be installed. It is noteworthy that, although the firearm 200 may resemble certain components of a firearm based on the AR platform, the firearm 200 may also be based on the other platforms. In other words, the present invention is not limited to firearms based on the AR platform.

In one of the embodiments shown in FIG. 1, the adapter 100 takes the form of an adapter between the standardized receiver and a Picatinny rail through an extension threaded socket on the standardized receiver. Referring to FIGS. 1-7, the adapter 100 includes a base block 110, a threaded plug 130, and a knob-driven mechanism, i.e., a mechanism that the user's hand could operate to cause a threaded plug 130 to rotate and thereby engage the receiver. In one of the embodiments, a knob-driven mechanism takes the form of 140, which includes an adjusting knob 142 and a detent system comprising a steel ball 150, a spring 152 and a socket set screw 154. Additionally, the adapter 100 includes a socket flat head screw 160. The lower receiver 210 of the illustrated AR pattern firearm 200 includes a threaded socket 212, shown in FIG. 3. Furthermore, the lower receiver 210 of the firearm 200 also includes an offset recess 214 near the threaded socket 212. The offset recess 214 is configured to engage a boss on a fixed stock or on an end plate used with an adjustable stock to prevent rotational movement of a fixed or an adjustable stock, for example. According to one embodiment of the invention, the base block 110 has an anti-rotational boss 112 on the receiver surface 120, which is configured to engage the offset recess 214 to prevent rotational movement of the adapter 100.

Figure 2:
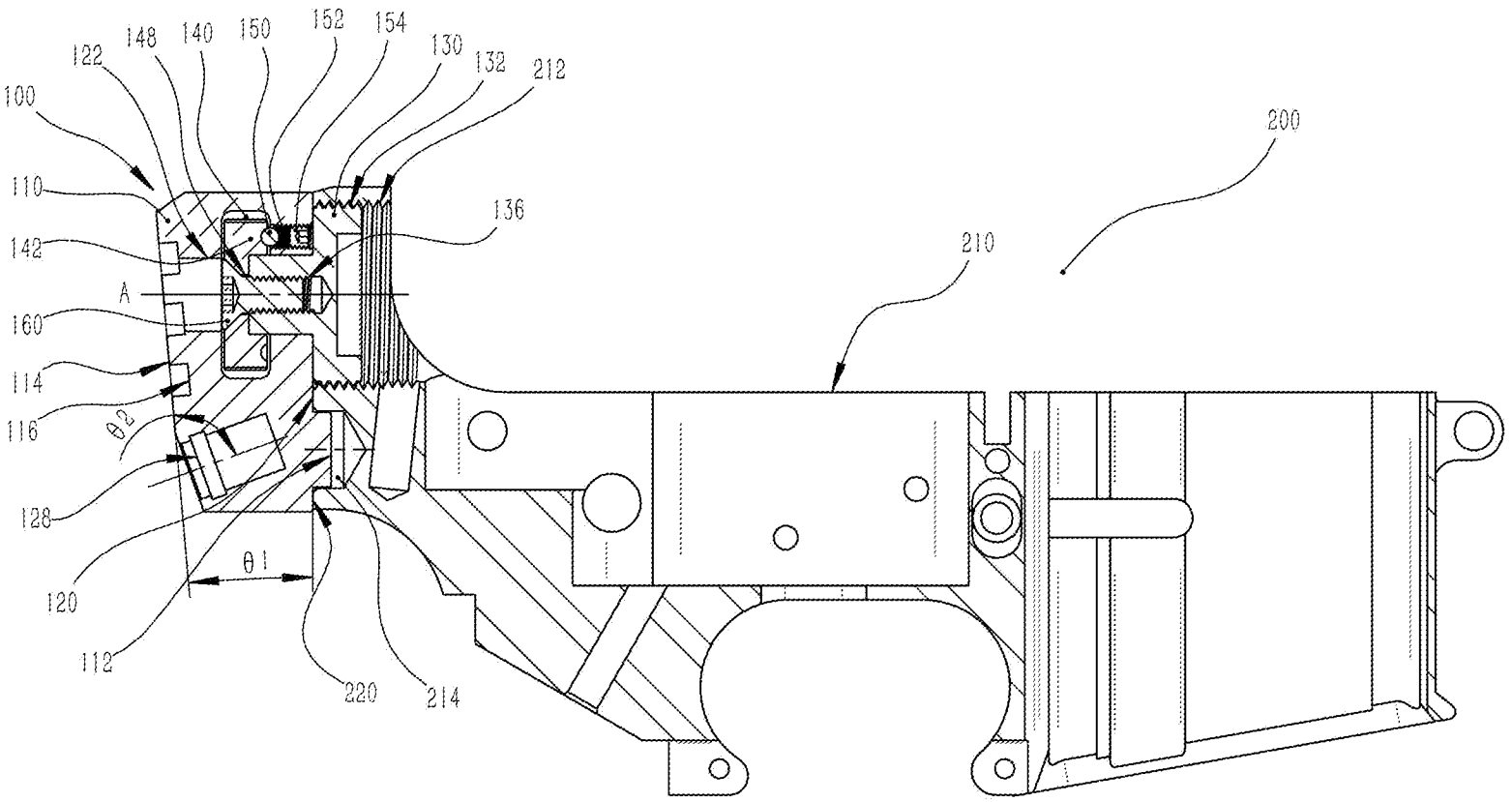
FIG. 2 is a cross-sectional view thereof.
Figure 3:
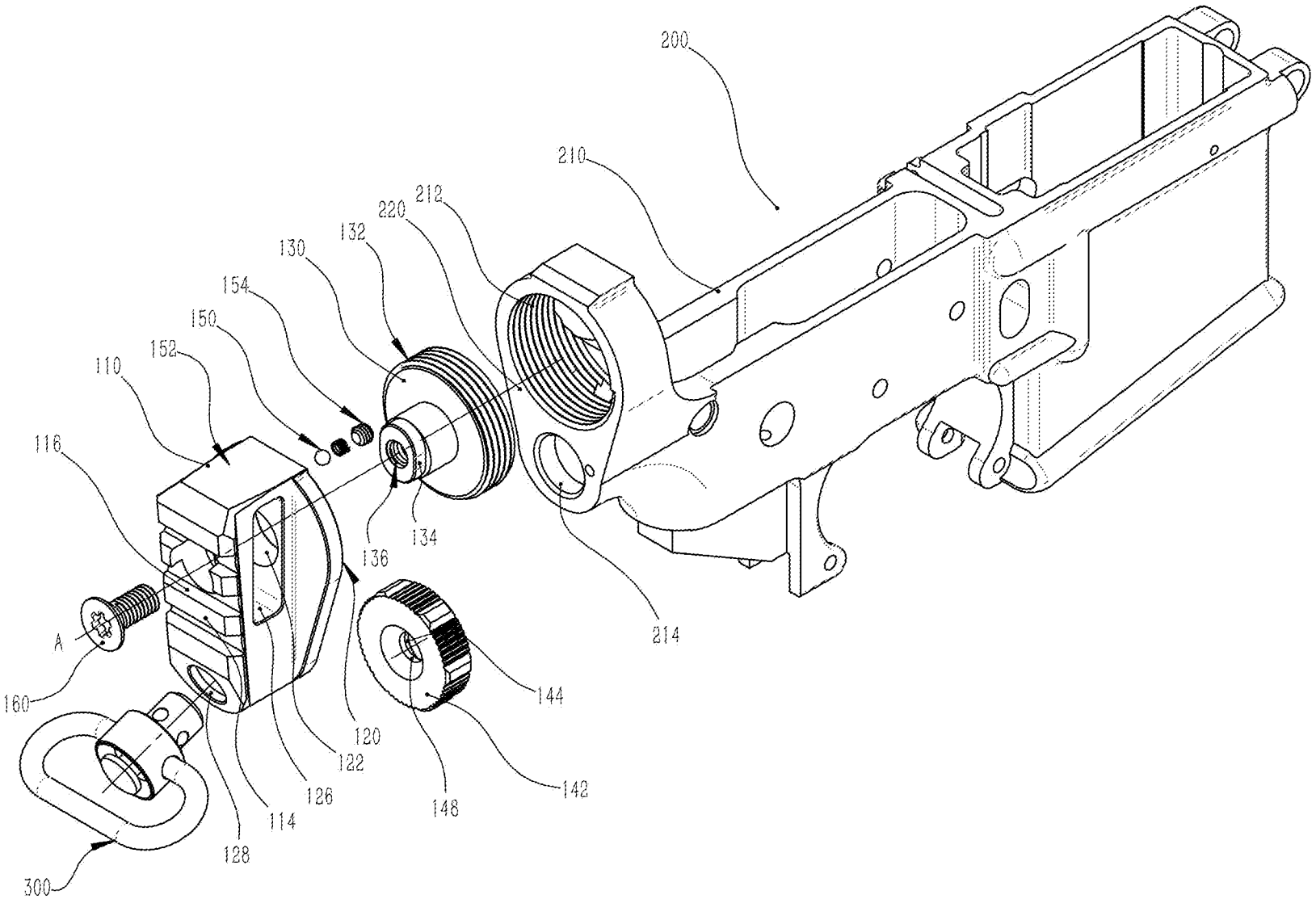
FIG. 3 is an exploded perspective view thereof.
Figure 4:
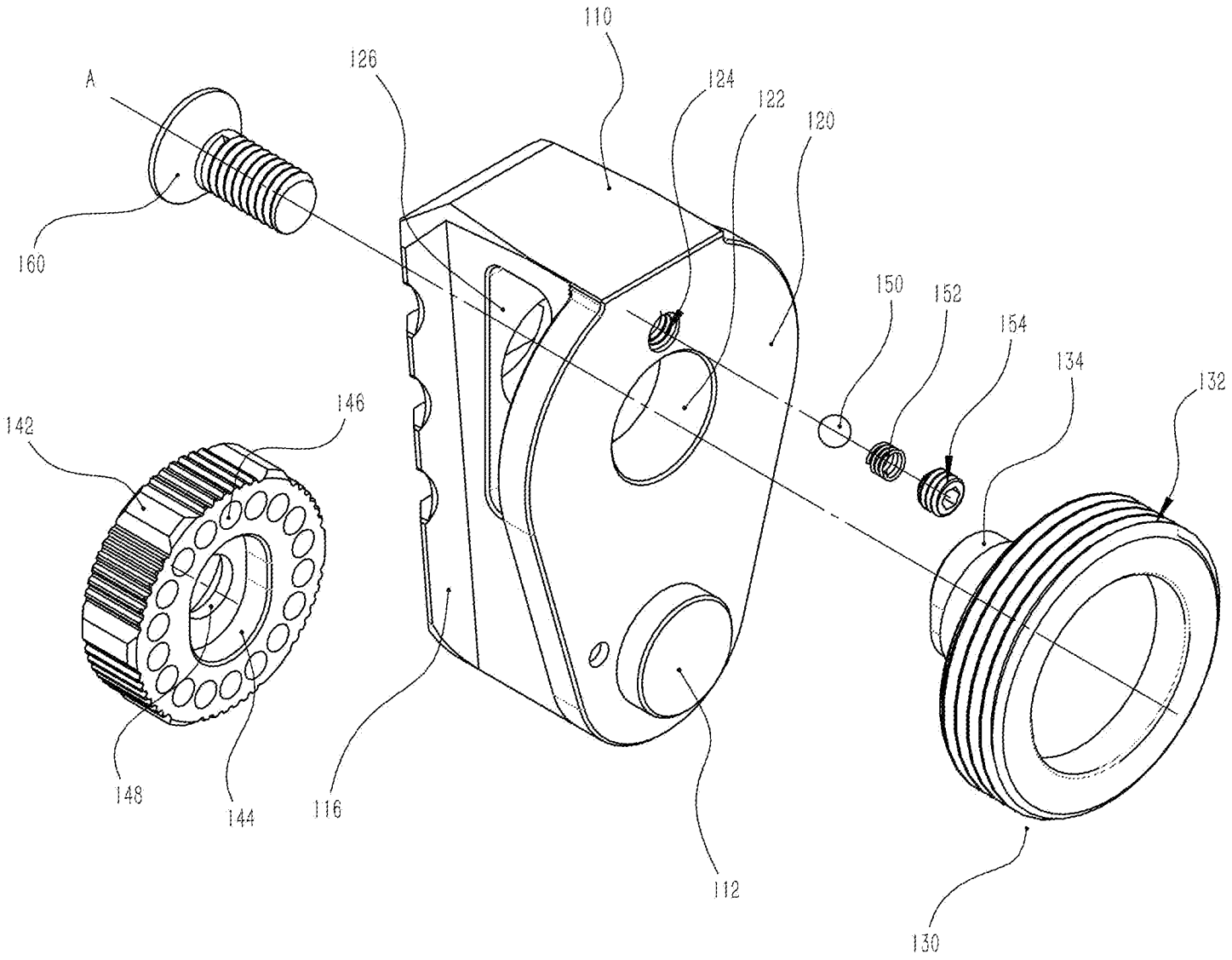
FIG. 4 is an exploded perspective view of the invention.
Figure 5:
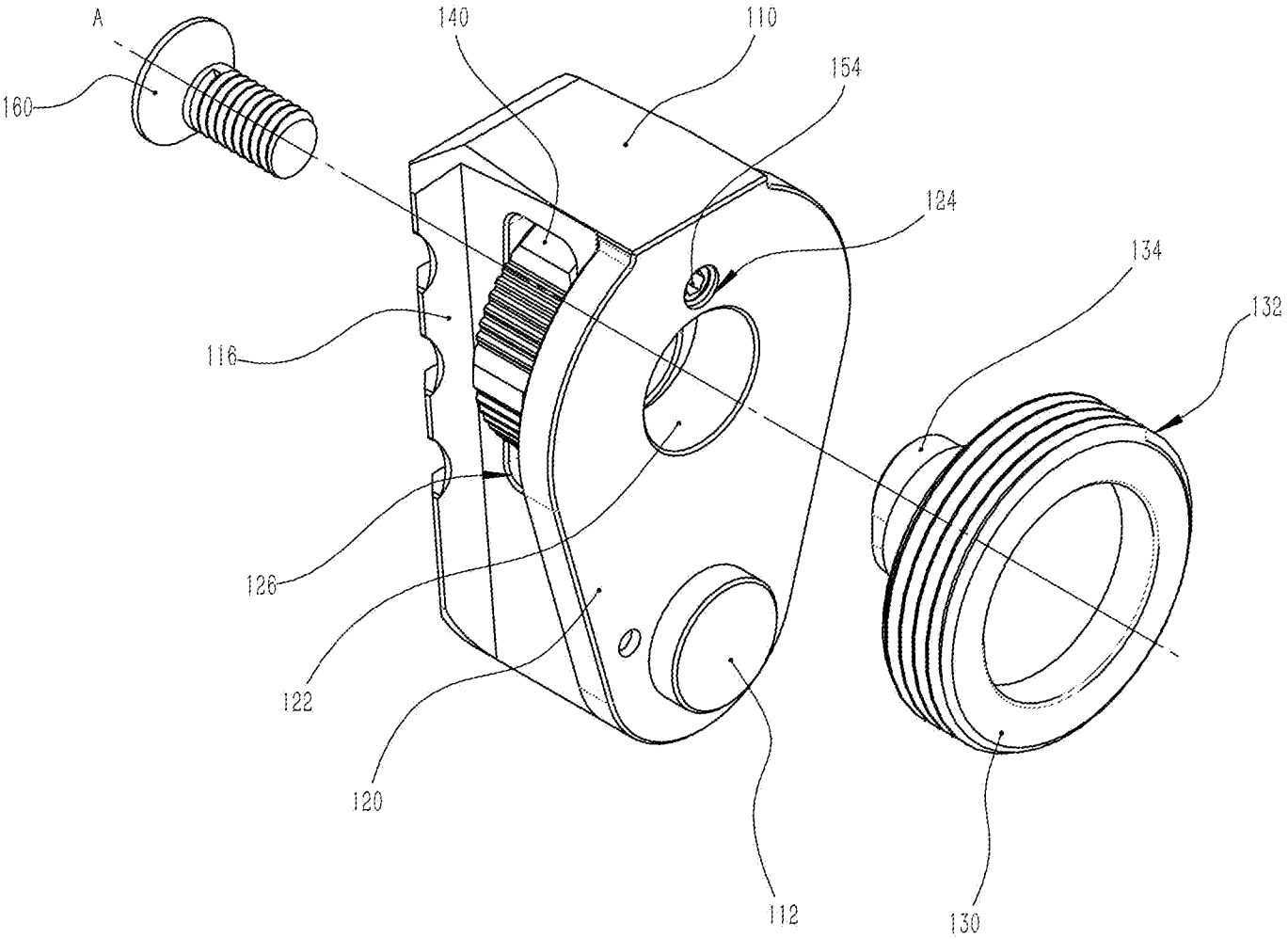
FIG. 5 is a partially exploded perspective view with the adjusting knob mechanism assembled in the invention.
Figure 7:
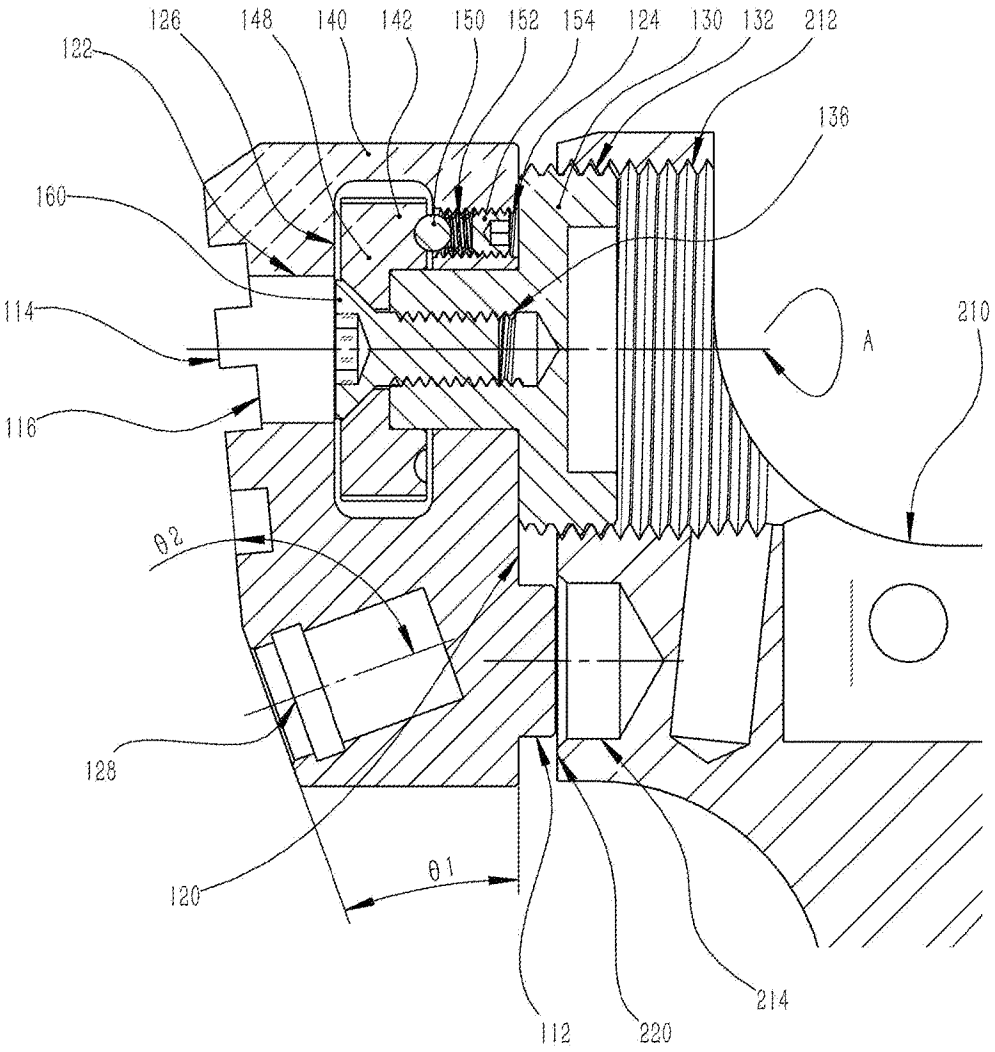
FIG. 7 is a partially cross-sectional view of the invention assembled to an AR-pattern lower receiver illustrating the adjusting knob mechanism configured to rotate the threaded plug and lock the base tightly to the rear surface of the lower receiver.

The adapter 100 is configured to be coupled to a receiver portion of the firearm 200, e.g., lower receiver 210 of a rifle, carbine or pistol based on the AR platform, shotguns or another platform, such as the chassis for bolt action rifles. Under a proposed design, the threaded plug 130 is configured to be threadably coupled into the threaded socket 212 of the lower receiver 210 as shown in FIGS. 2, 3, and 7. The threaded plug 130 includes an anti-rotational boss 134 and a threaded central bore 136 along the longitude axis A (the firing direction) of the threaded plug 130 and the lower receiver 210 as shown in FIG. 3. Furthermore, referring to FIGS. 2-4, the adjusting knob 142 of the knob-driven mechanism 140, includes a recess 144 that engages the anti-rotational boss 134, fastened to a threaded plug 130 with threaded central bore 136 by a socket flat head screw 160.

Under one of the proposed designs, the base block 110 has a through-hole 122 along the longitude axis A that is configured to install the threaded plug 130, the adjusting knob 142 and the socket flat head screw 160. The adjusting knob 142 is placed into a rectangular cutout 126 of the base block 110 with the central through-hole 122 of the base block 110 and the through-bole 148 of the adjusting knob 142 in alignment along the longitude axis A. Near the through-hole 122 is a threaded bore 124 on the receiver surface 120 that is designed to install the socket set screw 154. As shown in FIG. 2, the socket set screw 154 closes out the threaded bore 124 of the base block 110 and provides a base to be used to install the detent system comprising the steel ball 150 and the spring 152 near the socket set screw 154 inside the threaded bore 124. In the illustrated embodiment, the adjusting knob 142 includes several equi-spaced detents 146 along the longitude axis A on the front surface of the adjusting knob 142. Referring to all figures, as illustrated above, the fastener (the socket flat head screw 160) joins the base block 110, the threaded plug 130, and the adjusting knob 142. The head of the socket flat head screw 160 can be recessed into the base block 110 so as not to interfere with full function and use of the Picatinny rail 116 on the distal surface 114 of the base block 110. The adjusting knob 142 is configured to rotate the threaded plug 130 by the engagement between the anti-rotational boss 134 and the recess 144. The steel ball 150 drops into and stays in one of the detents 146 thereby, under the pressure of the spring 152, locking the adjusting knob 142 and the threaded plug 130 in that location. Rotating the adjusting knob 142 clockwise or counterclockwise with the user's fingers would cause the steel ball 150 to leave one of the detents 146 and compress the spring 152 until the steel ball 150 drops into the adjacent detent 146. The adjusting knob 142 of the knob-driven mechanism 140 could therefore rotate the threaded plug 130 and/or hold it in place and lock the receiver surface 120 tightly to the rear surface 220 of the lower receiver 210. A tool is unnecessary to operate the knob-driven mechanism 140. With more equi-spaced detents 146 along the longitude axis A on the front surface of the adjusting knob 142, finer adjustable rotational increments of the threaded plug 130 would be achieved.

In some implementations, the anti-rotational boss 112 is omitted due to the absence of the offset recess 214 on the lower receiver 210.

Figure 6:
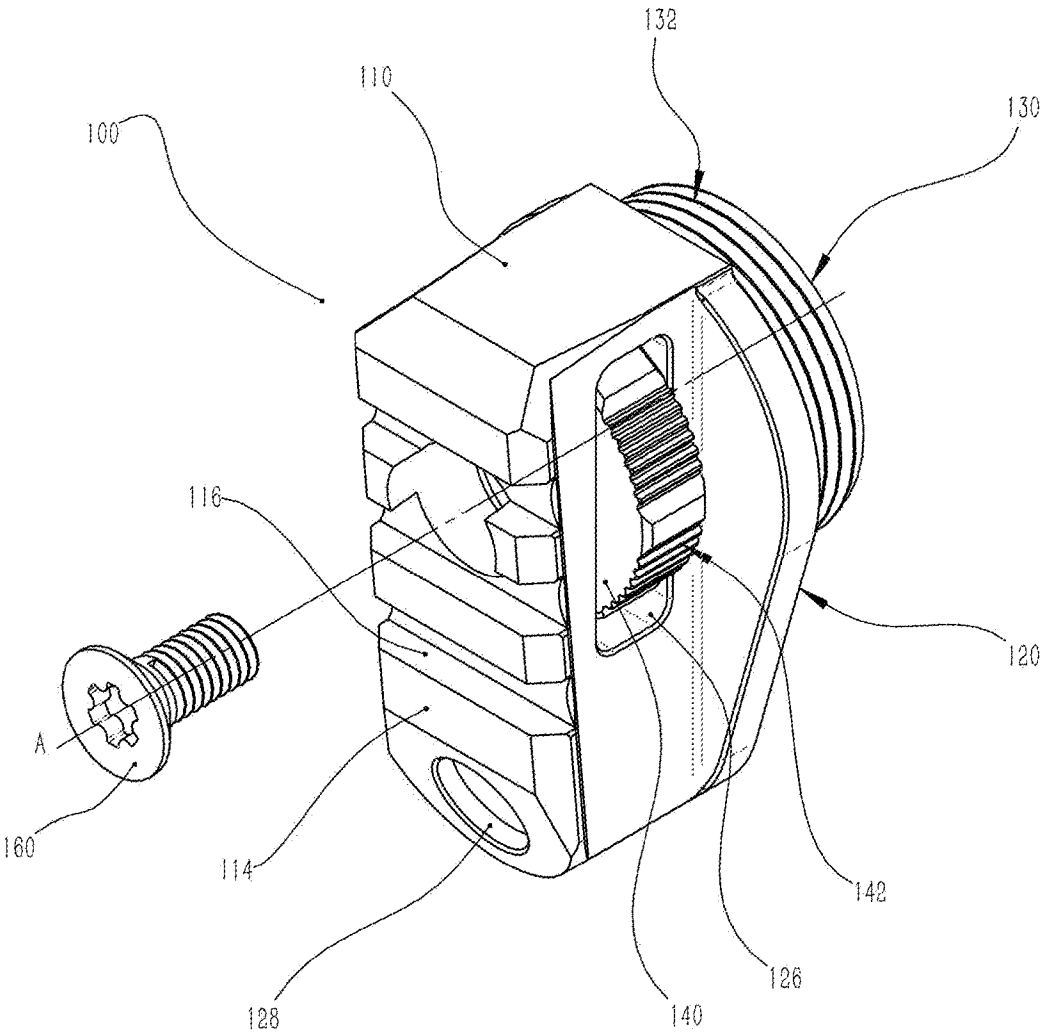
FIG. 6 is a partially exploded perspective view with the thread plug assembled in the invention.

Under the embodiment shown in FIGS. 1 and 6, the base block 110 of the adapter 100 provides a 3-slot Picatinny rail section 116 on the distal surface 114 as an adaptation means to mount a Picatinny interface stock/stabilizer assembly where a receiver extension, e.g., a stock designed for use with a Sig Sauer MCX™ or MPX™ type rifles, traditionally has been attached. Under other circumstances, other rail types may be adopted to interface with the accessory.

In one of the embodiments, as shown in FIGS. 2 and 7, there is an angle between the distal surface 114 is facing downwardly with an angle of $\theta_1$, which is set in order to be convenient for the installation and operation of the mounted a Picatinny interface stock/stabilizer assembly on the Picatinny rail section 116, for instance. $\theta_1$ may be adjusted for various implementations.

In addition, the base block 110 includes a QD socket 128 configured to engage a 360-degree free quick detach QD sling swivel 300 as shown in FIG. 3. As shown in FIGS. 2 and 7, there is an angle ($\theta_2$) between the distal surface 114 of the base block 110 and the axis of the QD socket 128, with $0° < \theta_2 < 90°$. It is also noteworthy that the angle $\theta_2$ of the proposed design may be different, adjusted for various implementations.

From the foregoing, it should be appreciated that various implementations of the present disclosure have been described herein for purposes of illustration, and that various modifications may be made without departing from the scope and spirit of the present invention. Accordingly, the various implementations disclosed herein are not intended to be limiting, with the true scope and spirit being indicated by the following claims.

What is claimed is:

1. A modular adapter for a firearm receiver that has a threaded socket, comprising:

a base block, comprising a receiver surface further comprising:

a threaded plug that is rotatable and configured to engage the threaded socket of the firearm receiver, and a distal surface that provides a means to attach an accessory or function as an end cap; and a knob-driven mechanism that is positioned between the receiver surface and the distal surface, and connected to and able to rotate the threaded plug.

2. A modular adapter according to claim 1, wherein the knob-driven mechanism comprises an adjusting knob; and a detent system, comprising several detents that are equi-spaced on the adjusting knob, a steel ball and a spring that are insertable into a threaded bore on the receiver surface, and a socket set screw in the threaded bore to close out the threaded bore and depress the spring, forcing the steel ball to engage one of the dentents on the adjusting knob.

3. A modular adapter according to claim 2, wherein the adjusting knob is placed in a cutout between the receiver surface and the distal surface, and is connected to the threaded plug through a hole between the receiver surface and the cutout.

4. A modular adapter according to claim 1, wherein the receiver surface further comprises an anti-rotational boss having a geometric design corresponding to, and to engage, the firearm receiver.

5. A modular adapter according to claim 4, wherein the geometric design is cylindrical.

6. A modular adapter according to claim 1, wherein the distal surface comprises a portion of MIL-STD 1913 accessory mounting rail.

7. A modular adapter according to claim 1, wherein the distal surface is substantially vertical.

8. A modular adapter according to claim 1, wherein the receiver surface and the distal surface are substantially parallel.

9. A modular adapter according to claim 1, wherein the distal surface is facing distally at a downward angle.

10. A modular adapter according to claim 1, further comprising a 360-degree free quick detach QD socket.

11. A modular adapter according to claim 10, wherein an axis of the 360-degree free quick detach QD socket is configured to tilt downwardly.

* * * * *